United States Patent [19]

Williams

[11] 4,355,854

[45] Oct. 26, 1982

[54] SELF-LOCKING MEANS

[76] Inventor: Robert A. Williams, 55 Bounty Rd. East, Fort Worth, Tex. 76116

[21] Appl. No.: 125,161

[22] Filed: Feb. 27, 1980

Related U.S. Application Data

[63] Continuation-in-part of Ser. No. 959,695, Nov. 13, 1978, abandoned.

[51] Int. Cl.[3] ..... H01R 13/62

[52] U.S. Cl. ..... 339/89 R; 339/DIG. 2; 285/318

[58] Field of Search ..... 339/89, 90, DIG. 2; 285/318

[56] References Cited

U.S. PATENT DOCUMENTS

| | | | |
|---|---|---|---|
| 3,218,095 | 11/1965 | Wiltse | 285/318 |
| 3,520,331 | 5/1966 | Boyle | 285/318 X |
| 3,532,101 | 10/1970 | Snyder, Jr. | 285/318 X |
| 3,869,186 | 3/1975 | Vetter | 339/DIG. 2 X |
| 4,066,314 | 1/1978 | Williams | 339/89 R |
| 4,165,910 | 8/1979 | Anderson | 339/90 R X |
| 4,243,290 | 1/1981 | Williams | 339/143 R |

*Primary Examiner*—Joseph H. McGlynn
*Assistant Examiner*—Frank H. McKenzie, Jr.
*Attorney, Agent, or Firm*—Arthur F. Zobal

[57] ABSTRACT

A coiled spring is located in an annular space formed between a coupling nut and a body for locking the nut to the body when the nut is threaded in place. The coiled spring may have a metal core, a resilient core, or an air core. In other embodiments, the locking means may comprise a plurality of separate coiled springs located at spaced apart positions around a metal or resilient core.

55 Claims, 16 Drawing Figures

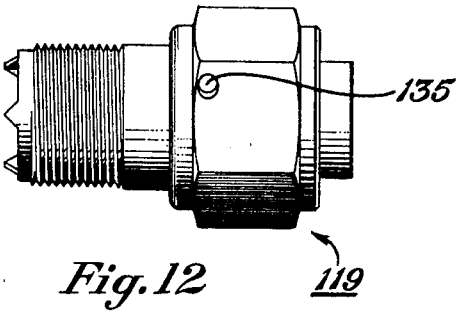
Fig. 12
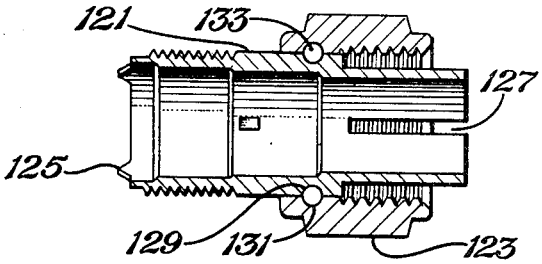
Fig. 13
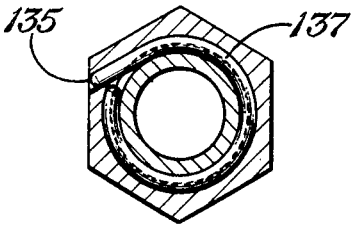
Fig. 14
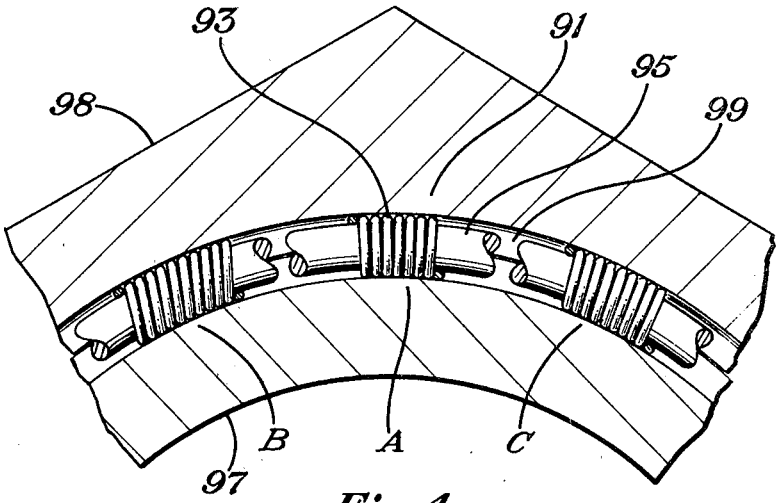
Fig. 4
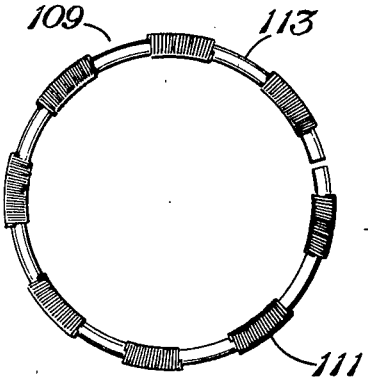
Fig. 10
Fig. 11
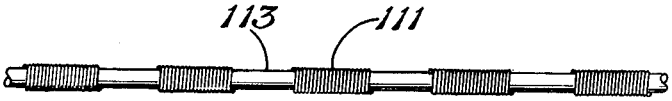
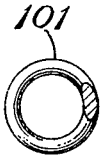
Fig. 6
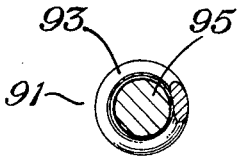
Fig. 3
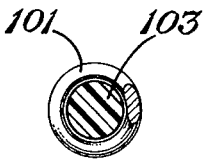
Fig. 7
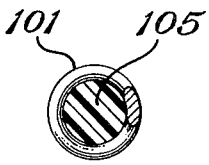
Fig. 8

SELF-LOCKING MEANS

This application is a continuation-in-part of U.S. patent application Ser. No. 959,695 filed Nov. 13, 1978 now abandoned.

BACKGROUND OF THE INVENTION

1. Field of the Invention

This invention relates to a self-locking means for locking a coupling nut to a body or assembly of a connector such as an electrical connector or a fluid connector.

2. Description of the Prior Art

For many years, components of electrical connectors and accessory backshell hardware used on aircraft have been lock wired into place to prevent high vibration from loosening the components. Because of high labor costs and the increasing need to change circuitry, the trend has been towards the use of self-locking mechanisms for these connectors and back shell hardware. The self-locking mechanisms used in the past such as rachet detents have short comings due to their bulk, cost, and constant torque loadings that when installed, repeatedly damages the connectors and the anti-rotational teeth of the connectors, causing quality assurance to be in doubt.

SUMMARY OF THE INVENTION

It is an object of the present invention to provide a simple, economical, and effective self-locking means for locking together components of connectors.

In one aspect, the self-locking means comprises a coiled spring adapted to be located in an annular spaced formed between a coupling nut and a body for locking the nut to the body when the nut is threaded in place. The coiled spring may have a metal core, resilient core, or an air core.

In other embodiments, the locking means comprises a plurality of separate coiled springs located at spaced apart positions around a metal core or a resilient core.

BRIEF DESCRIPTION OF THE DRAWINGS

FIG. 3 is a cross-section of the self-locking means of FIG. 2.

FIG. 4 illustrates the principle of operation of the self-locking means of the present invention.

FIG. 6 is a cross-section of the self-locking means of FIG. 5.

FIGS. 7–9 are cross sectional view of other embodiments of the self-locking means of the present invention.

FIG. 10 illustrates still another embodiment of the self-locking means of the present invention.

FIG. 11 illustrates the self-locking means of FIG. 10 prior to being formed into the configuration of FIG. 10.

FIG. 12 is a side view of an electrical connector.

FIG. 13 is a cross-section of the electrical connector of FIG. 12 with its contacts, insulation, and rubber grommet removed for purposes of clarity.

FIG. 14 illustrates a wire employed for locking a coupling nut to a connector.

DESCRIPTION OF THE PREFERRED EMBODIMENTS

Figure 1:
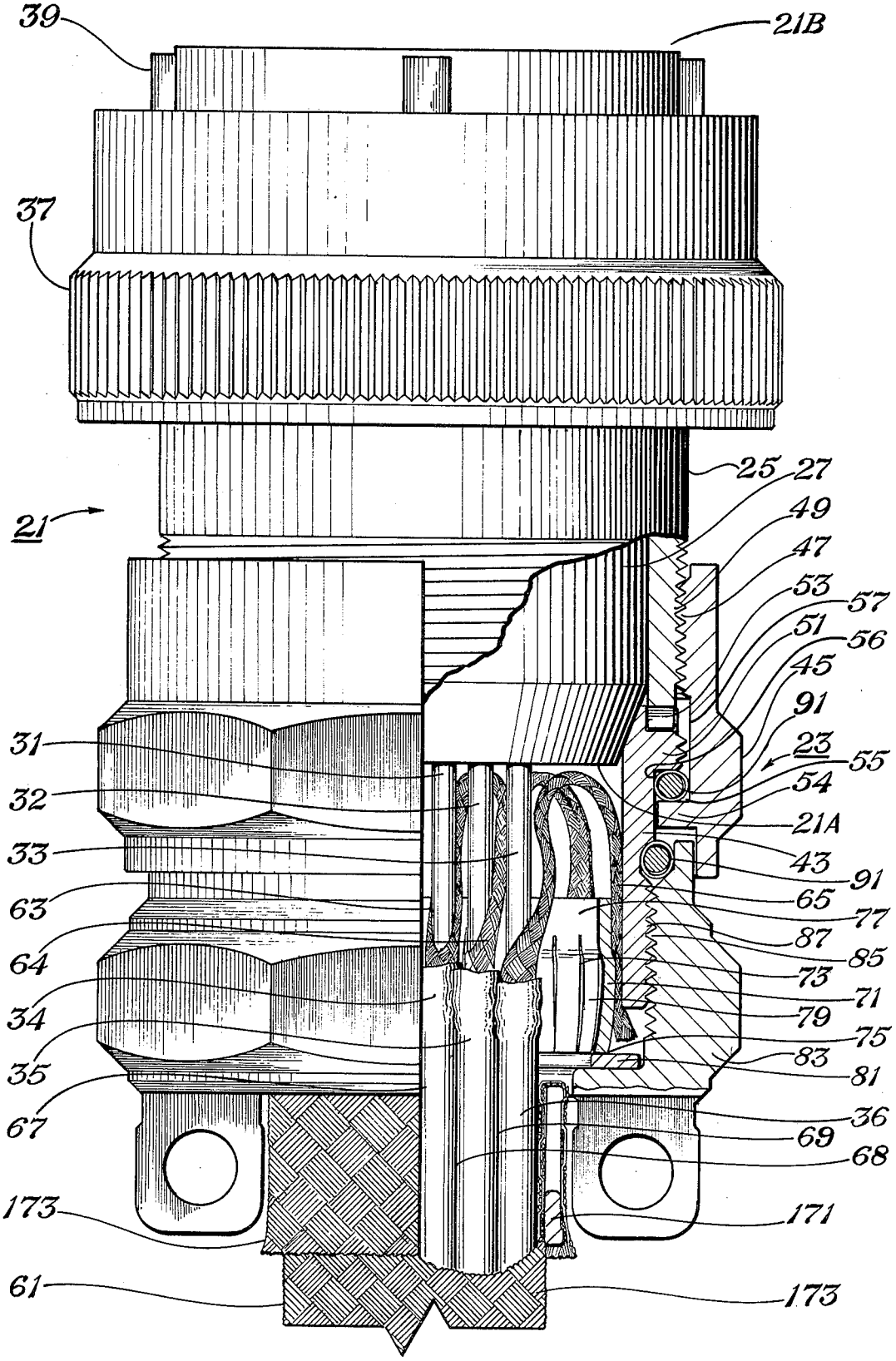
FIG. 1 is a side view of an electrical connector with a back shell accessory body which employs the self-locking means of the present invention.

Referring now to FIG. 1, there is disclosed an electrical connector 21 having a back shell accessory means 23 coupled to its rear end. The electrical connector 21 comprises a hollow cylindrical connector body 25 having located therein a rubber grommet 27 which supports a plurality of electrical contacts, not shown. The electrical contacts have rear ends adapted to be connected to electrical wires of leads at the rear end 21A of the connector. In FIG. 1, three wires 31, 32, and 33 of electrical leads 34, 35, and 36 are shown extending to the grommet 27 where they are connected to the rear ends of the contacts. The contacts extend through the grommet 27 to its front end terminating in either male or female terminals at the front end 21B of the connector for connection to mating terminals of another connector. Coupling nut 37 is rotatably located around the connector body 25 for coupling with a mating member of the other connector. Although not shown, a self-locking means of the present invention is located between the connector body 25 and the coupling nut 37 for locking the nut in place as it is rotated to secure it to a mating member of the other connector. Members 39 are keys secured to the outside of the front portion of the connector body 21 which slides into mating keyways of the other connector.

At the rear or back side of the connector 21, a hollow cylindrical back shell accessory body 43 is coupled to the connector body 25 by way of a coupling nut 45. The accessory body 43 and coupling nut 45 are of the type disclosed and claimed in U.S. Pat. No. 4,066,314. The nut 45 is coupled to the connector body 25 by threads 47 which mate with threads 49 of the connector body. The accessory body 43 is located within the coupling nut 45 by threading its outer shoulder 51 through the threads 47 of the nut 45 to the position shown prior to threading the nut 45 to the connector body 25. Although not shown, the rear end of the connector body 25 has teeth which mate with teeth formed on the front end of the outer shoulder 51 of the accessory body 43 to prevent the accessory body from rotating relative to the connector body 25 after it has been secured in place by the coupling nut 45. Reference numeral 53 indicates the tooth engaging area for the mating teeth which are of the type disclosed in FIGS. 6 and 7 of U.S. Pat. No. 4,066,314. Located in the annular space 55 formed between the outer shoulder 51 and the outer surface 56 of the accessory body 43 and the inner shoulder 54 and inner surface 57 of the coupling nut 45 is a self locking means of the present invention which preferably is the self-locking means 91 of FIG. 2. The purpose of the self-locking means 91 is to lock the nut 45 in place as it is threaded to the connector body 25.

Extending through the rear end of the accessory body 43 are the leads 34–36 of an electrical cable 61. Although only three leads are shown, it is to be understood that the cable 61 may have more leads. Surrounding the wires 31, 32, and 33 of the leads are metalic shields 63, 64, and 65 which are covered by insulating jackets 67, 68, and 69. The individual shields of the leads are terminated by stripping the insulating jackets from the ends of the leads, slitting the shields and folding them backwards against the inside wall of the accessory body 43 at its rear end as shown in FIG. 1. An annular metalic shield terminating member 71 is fitted inside the body 43 from its rear end tightly wedging the shields of the individual leads between the outside portion of the member 71 and the inside surface of the accessory body 43.

Member 71 is a single hollow cylindrical member having a plurality of spaced apart axial slits 73 formed in its end 75 and which extends toward its opposite end 77 defining a plurality of axially extending bendable and flexible fingers 79. The end 77 of the member 71 is a solid ring portion having an outside diameter slightly less then the portion defined by the fingers 79. This allows the end 77 of the member 71 to be readily slid past the shields. The fingers 79 bow outward and provide compression for securly holding the shields against the inside wall of the accessory body. Since the fingers 79 can move relative to each other, they will insure that good electrical contact is had between all of the individual shields and the inside wall of the accessory body 43 even though the size of the shields may vary. The shield termination means 71 as well as other embodiments thereof are fully disclosed and claimed in my copending U.S. Patent Application, filed on Oct. 30, 1978, and entitled "Shield Termination Means For Electrical Connector", Ser. No. 955,910, now U.S. Pat. No. 4,243,290.

A washer 81 and nut 83 are employed to tighten and hold the shield termination means 71 in place and to provide protection at the rear of the accessory body for the components located inside of the accessory body. As can be seen, the rear end cover nut 83 is coupled to the rear end of the accessory body by inner threads 85 which mate with other threads 87 formed at the inner rear end of the accessory body 43. A self-locking means of the present invention is located in the annular space formed between the accessory body 43 and the front end of the nut 83 to lock the nut 83 in place as it is threaded to the accessory body 43. Preferably, the self-locking means employed is the self-locking means 91 of FIG. 2.

The device 91 is the preferred self-locking means for locking a nut to a body or inner member in the condition wherein the self-locking means can be located in place around the body prior to location of the nut around the body as exist in FIG. 1 wherein the body or inner member is the accessory body 43.

Figure 2:
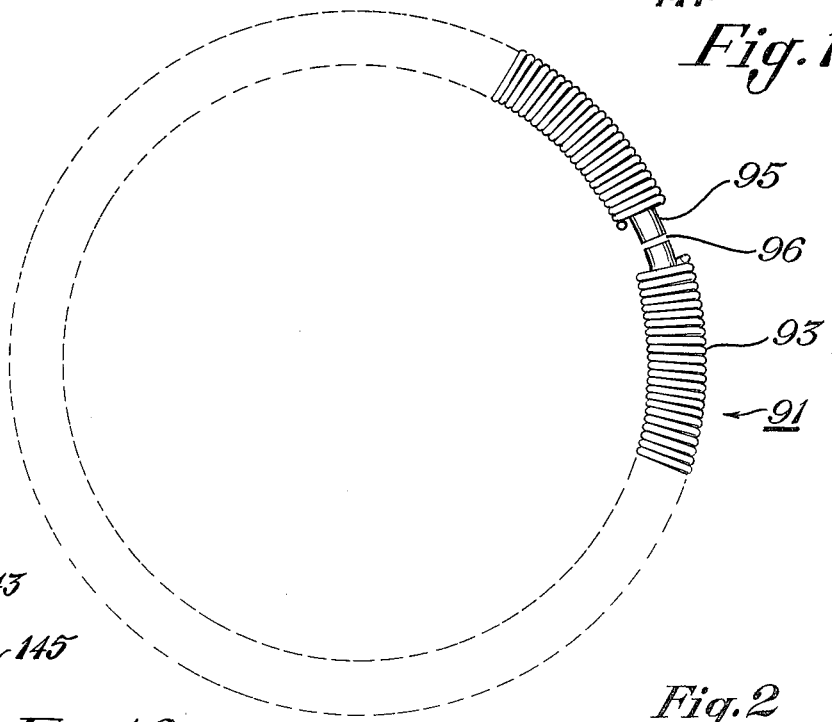
FIG. 2 illustrates one embodiment of the self-locking means of the present invention.

Referring now to FIGS. 2 and 3, the self-locking means 91 comprises a coiled metal spring 93 having a solid annular metal core 95 located within and extending through the coils of the spring holding the spring in an annular configuration. A gap 96 is formed between the ends of the core 95 to allow the device to be spread apart to allow it to be located around the accessory body, as shown in FIG. 1, or around other bodies or assemblies when it is desired to lock a coupling nut or other member in place. The gap 96 also allows for compression of the device to insure that it fits properly within the desired annular space. The metal core 95 not only holds the spring in an annular configuration but also confines coil movement and prevents crushing of the coils of the spring when the coupling nut is tightened. Preferably the spring 93 has a length sufficient to extend nearly 360° in the annular space in which it is to be located. Although not shown in FIG. 2, the ends of the spring 93 may be formed into hoods for hooking the ends of the spring together after it has been located in place.

Referring now to FIG. 4, the principal of operation of the self-locking means of the present invention will be described. The self-locking means 91 is shown. It is to be understood that the self-locking means of the other embodiments of the present invention operate in the same manner. They will be described subsequently. In FIG. 4, reference numeral 97 identifies an inner member or body which may be the accessory body 43. Reference numeral 98 identifies a coupling nut which may be the coupling nut 45 or 83. Nut 98 is rotatable relative to member 97. Formed between the nut 98 and the inner member 97 is an annular space 99 in which is located the self-locking means 91. Preferably the cross-sectional diameter of the coils of the spring 93 are slightly larger than the cross-sectional diameter of the annular space whereby the nut and body will engage the coils of the spring when the spring is located in the annular space. For example, the cross-sectional diameter of the coils of the spring 93 may be of the order of 0.001–0.002 of an inch greater than the cross-sectional diameter of the annular space 99. It is to be understood, however, that the cross-sectional diameter of the coils of the spring may be equal or slightly less (i.e., 0.001–0.002 of an inch less) than the cross-sectional diameter of the annular space 99. In this case, axial loading caused by threading of the nut will cause the coils of the spring to compress against the inner and outer walls of the annular space 99 formed by the inner member 97 and the outer nut 98. In FIG. 4, condition A illustrates the self-locking means 91 located in the space 99 prior to rotation of the coupling nut. Condition B illustrates the self-locking means after the nut has been rotated clockwise and condition C illustrates the self-locking means after the nut has been rotated counterclockwise.

Assume that the nut 98 is nut 45 in FIG. 1 which is rotated clockwise to thread the nut onto the connector body 25. Upon clockwise rotation of the nut, the coils of the spring 93 are moved by the nut and the body to assume the cocked position of Condition B of FIG. 4. If one now tries to rotate the nut counterclockwise to unthread the nut, resistance by the spring acting against the nut and the body is encountered. This is due to the fact that for counterclockwise rotation to be achieved, the coils of the spring 93 must be moved from Condition B to Condition C. Thus the spring 93 acts as a self-locking means. The self-locking feature is further enhanced by axial loading to a degree that finger tightening of the nut or outer member requires a wrench for removal. The axial loading due to threading of the nut, in effect, compresses and sets the coils of the spring making it difficult to move the spring from Condition B to Condition C. In tests conducted, finger tightening of a nut was achieved with 10 ounce-inches of torque. Twenty ounce-inches of torque was required to loosen the nut. Thus, as can be understood, there is provided a very simple process and means for self-locking a nut in place with little effort. Once locked in place, vibration cannot loosen the nut, however, it can be loosened with a wrench if it is desired to change circuitry, etc. Prior to tightening of the nut, the self-locking means of the present invention provides an indication that it is functioning since it produces a clicking sound as the nut is worked back and forth. After tightening, the spring prevents loosening of the nut with the same amount of torque also providing an indication that the self-locking means is functioning for its intended purpose.

For a right hand thread, it is desirable to have a counter-clockwise wound spring as the helical lay of the spring causes less anit-counter rotational resistance when threading a nut onto a member, conversely causing greater resistance when the nut is to be removed.

Figure 9:
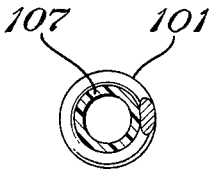

Although the self-locking means 91 of FIGS. 2 and 3 is preferred for use in locking the two nuts 45 and 83 of the accessory body 43 in place, it is to be understood that the self-locking means of FIGS. 5–11 also could be employed. The device of FIGS. 5 and 6 comprises a single spring 101 having an air core. Its ends are formed into hooks 101A and 101B for holding the ends together after the spring has been located in place around the accessory body 43. Preferably the spring 101 will have a length sufficient to extend nearly 360° in the annular space in which it is to be located. FIGS. 7–9 illustrate the coiled spring 101 having cores formed of resilient material such as silicone rubber, viton, neoprene, etc. In FIG. 7, the resilient core 103 is a solid core inserted through the coils of the spring while in FIG. 8, the resilient core 105 is a solid core molded in place inside the coils of the spring. The core 103 may be inserted in place by stretching the core to reduce its diameter and sliding the coils spring 101 around the stretched core. The core then is released to fill the inside diameter of the coils of the spring. The core 105 of FIG. 8 may be molded straight or in a desired ring shaped configuration. In FIG. 9, the core 107 is a resilient tubular member inserted through the coils of the spring 101. It is to be understood that the core 107 could be molded in place inside the coils of the spring either in a straight or ring shaped configuration.

FIG. 10 illustrates a self-locking means 109 formed by a plurality of separate coiled springs 111 located at spaced apart positions around a core 113. The core 111 may be a solid or tubular metallic split ring or a resilient solid or tubular member inserted or molded within the springs 113. In the event that the core is molded within the springs, it may be molded straight or in the desired ring shaped configuration. FIG. 11 illustrates a solid core 113 in a straight configuration prior to being formed to the desired ring configuration. In the embodiments of FIGS. 5–9 discussed above, it is to be understood that the hooks 101A and 101B may be eliminated from the ends of the spring 101.

Figure 5:
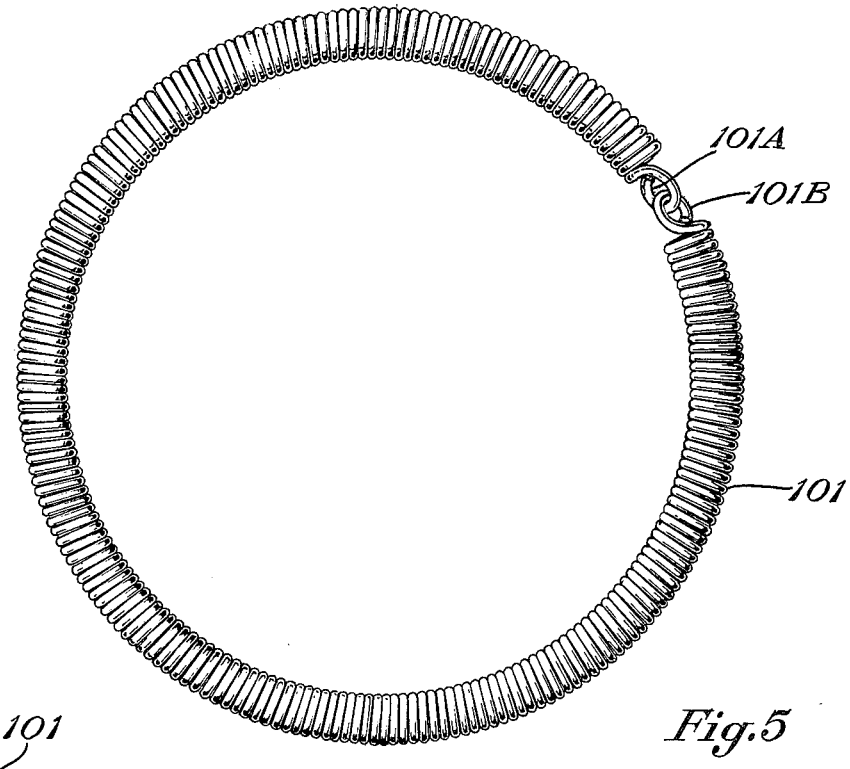
FIG. 5 illustrates another embodiment of the self-locking means of the present invention.

In the embodiments of FIGS. 7–11 wherein a resilient core is used, it is to be understood that the resilient core itself may have a flexible wire core. In the embodiment of FIGS. 5 and 6, wherein a single spring is used with an air core the spring wire will have a cross-section large enough to allow some compression of the coils of the spring without crushing. In the embodiment of FIGS. 2, 3, and 9–11 wherein the core is solid or tubular metallic core, the core will have dimensions sufficient to allow the coils of the spring to be compressed without crushing of the spring. The use of a solid or tubular metal core allows the use of finer coil wire for the spring. In the embodiments of FIGS. 7–11 wherein a resilient core is used with or without a smaller wire core, the resilient core material when properly confined, prevents crushing of the spring coils by limiting the amount of compression of the spring coils.

Referring now to FIGS. 12 and 13, there is disclosed an electrical connector 119 comprising a hollow cylindrical connector body 121 and a coupling nut 123. The contacts, insulation, and rubber grommet normally located in the connector body 121 are not illustrated for purposes of clarity. The connector body 121 has teeth 125 formed at its rear end for mating with teeth or indentations formed on the front end of a back shell body for preventing rotation of the back shell body. In addition, the connector body 121 has a slot 127 formed in the wall of its forward end for receiving a key of a mating connector. The nut 123 is employed to couple the connector 119 to the mating connector.

Grooves 129 and 131 are formed in the outer wall and inner wall respectively of the connector body 121 and nut 123 and which are in alignment when the connector body 121 and nut 123 are in the position shown to form an annular space or opening 133. An aperture 135 is formed through the wall of the nut 123 which extends to the groove 129 and hence to the annular space 133. FIG. 14 illustrates a prior method of locking the nut to the connector body. In this method, a heavy wire 137 is inserted into the opening 133 by way of the aperture 135. This technique is not self-locking and moveover it does not prevent the nut 123 from rotating, thus, vibration may cause the nut to rotate resulting in it being unthreaded from the other mating connector.

The self-locking means of the present invention, however, may be inserted into the annular space 133 by way of the aperture 135 to allow the nut 133 to be self-locked in place as it is rotated for threading purposes. For ease of insertion into the annular space 133 by way of the aperture 135, preferably the self-locking means of FIGS. 5 and 6 or those having a resilient core only of FIGS. 7, 8, and 9 will be used.

Figure 15:
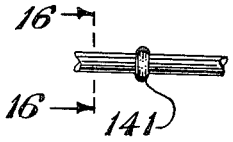
FIG. 15 illustrates another embodiment of the present invention.
Figure 16:
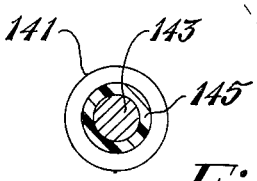
FIG. 16 is an enlarged cross-section of FIG. 15 taken along the lines 15—15 thereof.

In another embodiment, the self-locking means of the present invention may comprise a plurality of individual metallic rings surrounding a metallic or elastic core. Each ring may be split or of continuous form. For example, referring to FIGS. 15 and 16, three or more of the individual rings 141 may be equally spaced apart around a solid ring shaped metallic core 143 with resilient material 145 molded to the metallic core between the rings to maintain the individual rings in their desired position, yet to allow the rings to cant back and forth on the core. The plurality of individual rings carried by the core, will act to perform the same self-locking function as one or more coiled springs as described above.

Although the self-locking means of the present invention has been described for locking a nut and electrical connector together, it is to be understood that it could be employed for locking a nut to a fluid connector.

I claim:

1. A vibration resistant anti-counter rotational apparatus comprising:

first means;

second means having a portion adapted to be rotatably located around a portion of said first means, said second means and said first means comprising wall structure defining an annular space when said portion of said second means is located around said portion of said first means, said second means having thread means adapted to be threaded to other thread means when rotated in a first direction relataive to said first means, and coiled spring means located in said annular space formed when said portion of said second means is located around said portion of said first means, said coiled spring means being characterized such that adjacent coils of said coiled spring means are in close proximity to each other, said wall structure of said second means and said first means engaging said coils of said spring means and canting said coils of said spring means in said first direction when said thread means of said second means are threaded to said other thread means upon rotation of said second means in said first direction, relative to said first means, whereby increased resistance is provided to rotation of said second means, relative to said first means, in a direction opposite said first direction, said wall structure of said second means and said first means which engage said coils of said coiled spring means comprising smooth annular surfaces.

2. The apparatus of claim 1, wherein;

said coiled spring means comprises a single coiled spring.

3. The apparatus of claim 1, wherein:

said coiled spring means comprises a single coiled spring having a length sufficient to extend nearly 360° in said annular space.

4. The apparatus of claim 2, wherein;

said coiled spring has a solid core means located within the coils of said spring means.

5. The apparatus of claim 4, wherein;

said core means comprises metal.

6. The apparatus of claim 4, wherein;

said core means comprises resilient material which is non-metallic and non-gaseous.

7. The apparatus of claim 2, wherein;

said coiled spring has an air core.

8. The apparatus of claim 1, wherein;

said coiled spring means comprises a plurality of separate coiled springs located around a core means formed of solid material.

9. The apparatus of claim 8, wherein;

said core means comprises metal.

10. The apparatus of claim 8, wherein:

said core means comprises resilient material which is non-metallic and non-gaseous.

11. The apparatus of claim 8, wherein:

said plurality of separate coiled springs are spaced apart from each other.

12. A self-locking means adapted to be located in an annular space formed between a first and second means for locking the first and second means together, wherein said second means has threads adapted to be threaded to other threads, comprising:

core means formed of solid material having a plurality of spaced apart coiled springs located around said core means, said core means with said coiled springs being adapted to be located in said annular space for locking the first and second means together when said second means is threaded to other threads.

13. The self-locking means of claim 12, wherein:

said core means comprises metal.

14. The self-locking means of claim 12, wherein;

said core means comprises a resilient material.

15. A vibration resistant anti-counter rotational apparatus comprising;

first means;

second means having a portion adapted to be rotatably located around a portion of said first means and secured relative to said first means upon rotation of said second means in a first direction relative to said first means;

said second means and said first means comprising wall structure defining an annular space when said portion of said second means is located around said portion of said first means, and;

core means formed of solid material having a plurality of spaced apart encircling means surrounding said core means;

said core means with said plurality of spaced apart encircling means being located in said annular space formed when said portion of said second means is located around said portion of said first means for providing resistance to rotation by said second means, relative to said first means, in a direction opposite said first direction.

16. The apparatus of claim 15, wherein:

each of said encircling means comprises a coiled spring.

17. The apparatus of claim 15, wherein:

each of said encircling means comprises a separate ring shaped member.

18. A self-locking means adapted to be located in an annular space formed between first and second means for locking the first and second means together, wherein said second means has threads adapted to be threaded to other threads, comprising:

core means formed of solid material having a plurality of spaced apart encircling means surrounding said core means, said core means with said plurality of spaced apart encircling means being adapted to be located in said annular space for locking the first and second means together when the second means is threaded to other threads.

19. A method of securing together a first and second means wherein said second means is adapted to be located at least partially around said first means forming an annular space defined by smooth annular surfaces of said first and second means, said second means having thread means adapted to be threaded to other thread means when rotated in a first direction, said method comprising the steps of:

locating a coiled spring means within said annular space, said coiled spring means being characterized such that adjacent coils of said coiled spring means are in close proximity to each other, rotating said second means in said first direction relative to said first means for threading said thread means of said second means to other thread means, as said second means is rotated in said first direction relative to said first means for threading said thread means of said second means to said other thread means, engaging said coils of said coiled spring means with said smooth annular surfaces of said second means and said first means and canting said coils of said coiled spring means in said first direction to provide increased resistance to rotation of said second means, relative to said first means, in a direction opposite said first direction.

20. A vibration resistant anti-counter rotational apparatus comprising:

first means;

second means having a portion adapted to be rotatably located around a portion of said first means and secured relative to said first means upon rotation of said second means in a first direction relative to said first means;

said second means and said first means comprising smooth annular wall structure defining an annular space when said portion of said second means is located around said portion of said first means, coiled spring means located in said annular space with its coils engaged and canted in said first direction by said smooth annular wall structure of said first and second means for providing resistance to rotation of said second means, relative to said first means, in a direction opposite said first direction, and;

core means located within the coils of said spring means;

said core means comprising resilient material which is non-metallic and non-gaseous.

21. The apparatus of claims 15, 16, or 17, wherein:

said core means comprises metal.

22. The apparatus of claims 15, 16, or 17, wherein:

said core means comprises resilient material which is non-metallic and non-gaseous.

23. The apparatus of claim 1, wherein:

said wall structure of said second means and said first means defining said annular space formed when said portion of said second means is located around said portion of said first means comprises inner and outer smooth annular surfaces spaced radially from each other and formed on said second means and on said first means respectively and two axially spaced smooth surfaces formed on said second means and on said first means respectively, said coiled spring means when located in said annular space formed is located around said outer smooth annular surface of said first means and within said inner smooth annular surface of said second means, with said outer smooth annular surface of said first means being located within the inner edge of said coiled spring means and with said inner and outer smooth annular surfaces of said second means and first means engaging said coils of said coiled spring means, the distance between said two axially spaced smooth surfaces decreasing as said thread means of said second means are threaded to said other thread means when said second means is rotated in said first direction whereby at least one of said two axially spaced smooth surfaces engages the coils of said coiled spring means to apply axial force to said coils of said coiled spring means thereby increasing the radial force applied between said coils of said coiled spring means and said inner and outer smooth annular surfaces of said second means and said first means, said inner and outer smooth annular surfaces and said one axially spaced smooth surface engaging said coils of said coiled spring means and canting said coils of said coiled spring means in said first direction when said thread means of said second means are threaded to said other thread means upon rotation of said second means in said first direction, relative to said first means, thereby increasing the resistance to rotation of said second means, relative to said first means, in a direction opposite said first direction.

24. The apparatus of claim 1, wherein:

said wall structure of said second means and said first means which engage said coils of said spring means applies a force to said coils of said coiled spring means which has a component parallel to the axis of said annular space.

25. The apparatus of claim 1, wherein:

said wall structure of said second means and said first means which engage said coils of said coiled spring means applies radial force to said coils of said coiled spring means.

26. The apparatus of claim 1, wherein:

said structure of said second means and said first means which engage said coils of said coiled spring means applies axial and radial force to said coils of said coiled spring means.

27. The apparatus of claim 1, wherein:

said wall structure of said second means and said first means which engage said coils of said coiled spring means comprises two smooth annular surfaces spaced axially from each other.

28. The apparatus of claim 1, wherein:

said wall structure of said second means and said first means defining said annular space formed when said portion of said second means is located around said portion of said first means comprises inner and outer smooth annular surfaces spaced radially from each other and formed on said second means and on said first means respectively, said coiled spring means when located in said annular space formed is located around said outer smooth annular surface of said first means and within said inner smooth annular surface of said second means, with said outer smooth annular surface of said first means being located within the inner edge of said coiled spring means and with said inner and outer smooth annular surfaces of said second means and said first means engaging said coils of said coiled spring means, said inner and outer smooth annular surfaces engaging said coils of said coiled spring means and canting said coils of said coiled spring means in said first direction when said thread means of said second means are threaded to said other thread means upon rotation of said second means in said first direction, relative to said first means, thereby increasing the resistance to rotation of said second means, relative to said first means, in a direction opposite said first direction.

29. The apparatus of claim 1, wherein:

said canted coils of said coiled spring means prevent said second means from being unthreaded unless the torque applied to said second means produces a sufficient force on said coils of said coiled spring means to cant them in a direction opposite said first direction.

30. The apparatus of claim 1, wherein:

said wall structure of said second means and said first means defining said annular space formed when said portion of said second means is located around said portion of said first means comprises inner and outer smooth annular surfaces spaced radially from each other and formed on said second means and on said first means respectively and two axially spaced smooth surfaces formed on said second means and on said first means respectively, when said second means is rotated in said first direction relative to said first means for threading said thread means of said second means to said other thread means, said coils of said coiled spring means are engaged by said two axially spaced smooth surfaces and by said inner and outer smooth annular surfaces and canted in said first direction thereby increasing the resistance to rotation of said second means, relative to said first means, in a direction opposite said first direction.

31. The apparatus of claims 23, 28 or 30, wherein:

a substantially greater amount of torque is required to be applied to said second means to unthread it from said other thread means than is required initially to thread it to said other thread means and to cant said coils of said coiled spring means in said first direction.

32. The apparatus of claims 23, 28, or 30, wherein:

the coils of said coiled spring means have an outer diameter greater than the distance between said inner and outer smooth annular surface prior to location of said coiled spring means in said annular space.

33. The apparatus of claims 1, 23, 28, or 30, wherein: said other thread means are formed on said first means.

34. The apparatus of claims 1, 23, 28, or 30, wherein: said other thread means are formed on a third means.

35. A method of securing together a first and second means wherein said second means is adapted to be located at least partially around said first means forming an annular space defined by inner and outer smooth annular surfaces spaced radially from each other and formed on said second means and on said first means respectively, said second means having thread means adapted to be threaded to other thread means when rotated in a first direction, said method comprising the steps of:

locating a coiled spring means within said annular space around said outer smooth surface of said first means and within said inner smooth surface of said second means with said outer smooth surface of said first means being located within said inner edge of said coiled spring means, said coiled spring means being characterized such that adjacent coils of said coiled spring means are in close proximity to each other, rotating said second means in said first direction relative to said first means for threading said thread means of said second means to said other thread means, as said second means is rotated in said first direction relative to said first means for threading said thread means of said second means to said other thread means, engaging said coils of said coiled spring means with said inner and outer smooth annular surfaces of said second means and said first means respectively and canting said coils of said coiled spring means in said first direction whereby a substantially greater amount of torque is required to be applied to said second means to unthread it from said other thread means than is required initially to thread it to said other thread means and canting said coils of said coiled spring means in said first direction.

36. A method of securing together a first and second means wherein said second means is adapted to be located at least partially around said first means forming an annular space defined by inner and outer smooth annular surfaces spaced radially from each other and formed on said second means and on said first means respectively and two axially spaced smooth surfaces formed on said second means and on said first means respectively, said second means having thread means adapted to be threaded to other thread means when rotated in a first direction, said method comprising the steps of:

locating a coiled spring means within said annular space around said outer smooth annular surface of said first means and within said inner smooth annular surface of said second means with said outer smooth annular surface of said first means being located within the inner edge of said coiled spring means, said coiled spring means being characterized such that adjacent coils of said coiled spring means are in close proximity to each other, rotating said second means in said first direction relative to said first means for threading said thread means of said second means to said other thread means, as said second means is rotated in said first direction relative to said first means for threading said thread means of said second means to said other thread means engaging said coils of said coiled spring means with at least one of said two axially spaced smooth surfaces and with said inner and outer smooth annular surfaces and canting said coils of said coiled spring means in said first direction whereby a substantially greater amount of torque is required to be applied to said second means to unthread it from said other thread means than is required initially to thread it to said other thread means and to cant said coils of said coiled spring means in said first direction.

37. The method of claim 36, wherein:

as said second means is rotated in said first direction relative to said first means for threading said thread means of said second means to said other thread means, said coils of said coiled spring means are engaged by said two axially spaced smooth surfaces and by said inner and outer smooth annular surfaces and canted in said first direction whereby a substantially greater amount of torque is required to be applied to said second means to unthread it from said other thread means than is required initially to thread it to said other thread means and to cant said coils of said coiled spring means in said first direction.

38. The method of claims 35, 36, or 37, wherein:

the coils of said coiled spring means have an outer diameter greater than the distance between said inner and outer smooth annular surfaces prior to location of said coiled spring means in said annular space.

39. A vibration resistant anti-counter rotational apparatus, comprising:

first means, second means having a portion adapted to be rotatably located around a portion of said first means and secured relative to said first means upon rotation of said second means in a first direction relative to said first means, said second means and said first means comprising wall structure forming an annular space when said portion of said second means is located around said portion of said first means and defined by inner and outer smooth annular surfaces spaced radially from each other and formed on said second means and on said first means respectively, coiled spring means located in said annular space formed when said portion of said second means is located around said portion of said first means, said coiled spring means being characterized such that adjacent coils of said coiled spring means are in close proximity to each other, said inner and outer smooth annular surfaces of said second means and said first means engaging said coils of said spring means and canting said coils of said spring means in said first direction when said second means is rotated in said first direction, relative to said first means, whereby increased resistance is provided to rotation of said second means, relative to said first means, in a direction opposite said first direction, the coils of said coiled spring means having an outer diameter greater than the distance between said inner and outer smooth annular surfaces prior to location of said coiled spring means in said annular space.

40. The method of claim 19, wherein:

said structure of said second means and said first means which engage said coils of said coiled spring means comprises two smooth annular surfaces spaced axially from each other.

41. The method of claim 19, wherein:

said wall structure of said second means and said first means defining said annular space formed when said portion of said second means is located around said portion of said first means comprises inner and outer smooth annular surfaces spaced radially from each other and formed on said second means an on said first means respectively, said coiled spring means when located in said annular space formed is located around said outer smooth annular surface of said first means and within said inner smooth annular surface of said second means, with said outer smooth annular surface of said first means being located within the inner edge of said coiled spring means and with said inner and outer smooth annular surfaces of said second means and said first means engaging said coils of said coiled spring means, said inner and outer smooth annular surfaces engaging said coils of said coiled spring means and canting said coils of said coiled spring means in said first direction when said thread means of said second means are threaded to said other thread means upon rotation of said second means in said first direction, relative to said first means, thereby increasing the resistance to rotation of said second means, relative to said first means, in a direction opposite said first direction.

42. The apparatus of claims 23, 28, 30, or 39 wherein said inner and outer smooth annular surfaces of said second means and said first means comprise inner and outer smooth cylindrical surfaces.

43. The method of claims 35 or 41 wherein said inner and outer smooth annular surfaces of said second means and said first means comprise:

inner and outer smooth cylindrical surfaces.

44. The apparatus of claim 27, wherein:

as said thread means of said second means are threaded to said other thread means upon rotation of said second means in said first direction, relative to said first means, the axial distance between said two smooth annular surfaces decreases allowing said two smooth annular surfaces to engage and cant said coils of said spring means in said first direction, when said two smooth annular surfaces engage and cant said coils of said spring means in said first direction, said spring means prevents further decrease of the distance between said two smooth annular surfaces.

45. The method of claim 40, wherein:

as said thread means of said second means are threaded to said other thread means upon rotation of said second means in said first direction, relative to said first means, the axial distance between said two smooth annular surfaces decreases allowing said two smooth annular surfaces to engage and cant said coils of said spring means in said first direction, when said two smooth annular surfaces engage and cant said coils of said spring means in said first direction, said spring means prevents further decrease of the distance between said two smooth annular surfaces.

46. A vibration resistant anti-counter rotational apparatus comprising:

first structural means;

second structural means having a portion adapted to be rotatably located around a portion of said first structural means, said second structural means and said first structural means comprising wall structure defining an annular space when said portion of said second structural means is located around said portion of said first structural means, one of said structural means having thread means adapted to be threaded to other thread means when rotated in a first direction relative to said other structural means, and coiled spring means located in said annular space formed when said portion of said second structural means is located around said portion of said first structural means, said coiled spring means being characterized such that adjacent coils of said coiled spring means are in close proximity to each other, said wall structure of said second structural means and said first structural means engaging said coils of said spring means and canting said coils of said spring means in said first direction when said thread means of said one structural means are threaded to said other thread means upon rotation of said one structural means in said first direction, relative to said other structural means, whereby increased resistance is provided to rotation of said one structural means, relative to said other structural means, in a direction opposite said first direction, said wall structure of said second structural means and said first structural means which engage said coils of said coiled spring means comprising smooth annular surfaces.

47. The apparatus of claim 46, wherein:

said wall structure of said second structural means and said first structural means defining said annular space formed when said portion of said second structural means is located around said portion of said first structural means comprises inner and outer smooth annular surfaces spaced radially from each other and formed on said second structural means and on said first structural means respectively and two axially spaced smooth surfaces formed on said second structural means and on said first structural means respectively, said coiled spring means when located in said annular space formed is located around said outer smooth annular surface of said first structural means and within said inner smooth annular surface of said second structural means, with said outer smooth annular surface of said first structural means being located within the inner edge of said coiled spring means and with said inner and outer smooth annular surfaces of said second structural means and first structural means engaging said coils of said coiled spring means, the distance between said two axially spaced smooth surfaces decreasing as said thread means of said one structural means are threaded to said other thread means when said one structural means is rotated in said first direction whereby at least one of said two axially spaced smooth surfaces engages the coils of said coiled spring means to apply axial force to said coils of said coiled spring means thereby increasing the radial force applied between said coils of said coiled spring means and said inner and outer smooth annular surfaces of said second structural means and said first structural means, said inner and outer smooth annular surfaces and said one axially spaced smooth surface engaging said coils of said coiled spring means and canting said coils of said coiled spring means in said first direction when said thread means of said one structural means are threaded to said other thread means upon rotation of said one structural means in said first direction, relative to said other structural means, thereby increasing the resistance to rotation of said one structural means, relative to said other structural means, in a direction opposite said first direction.

48. The apparatus of claim 46, wherein:

said structure of said second structural means and said first structural means which engage said coils of said coiled spring means comprises two smooth annular surfaces spaced axially from each other.

49. The apparatus of claim 46, wherein:

said wall structure of said second structural means and said first structural means defining said annular space formed when said portion of said second structural means is located around said portion of said first structural means comprises inner and outer smooth annular surface spaced radially from each other and formed on said second structural means and on said first structural means respectively, said coiled spring means when located in said annular space formed is located around said outer smooth annular surface of said first structural means and within said inner smooth annular surface of said second structural means, with said outer smooth annular surface of said first structural means being located within the inner edge of said coiled spring means and with said inner and outer smooth annular surfaces of said second structural means and said first structural means engaging said coils of said coiled spring means, said inner and outer smooth annular surfaces engaging said coils of said coiled spring means and canting said coils of said coiled spring means in said first direction when said thread means of said one structural means are threaded to said other thread means upon rotation of said one structural means in said first direction, relative to said other structural means, thereby increasing the resistance to rotation of said one structural means, relative to said other structural means, in a direction opposite said first direction.

50. The apparatus of claim 46, wherein:

said wall structure of said second means and said first means defining said annular space formed when said portion of said second means is located around said portion of said first means comprises inner and outer smooth annular surfaces spaced radially from each other and formed on said second means and on said first means respectively and two axially spaced smooth surfaces formed on said second means and on said first means respectively, when said one structural means is rotated in said first direction relative to said other structural means for threading said thread means of said one structural means to said other thread means, said coils of said coiled spring means are engaged by said two axially spaced smooth surfaces and by said inner and outer smooth annular surfaces and canted in said first direction thereby increasing the resistance to rotation of said one structural means, relative to said other structural means, in a direction opposite said first direction.

51. The apparatus of claim 48, wherein:

as said thread means of said one structural means are threaded to said other thread means upon rotation of said one structural means in said first direction, relative to said other structural means, the axial distance between said two smooth annular surfaces decreases allowing said two smooth annular surfaces to engage and cant said coils of said spring means in said first direction, when said two smooth annular surfaces engage and cant said coils of said spring means in said first direction, said spring means prevents further decrease of the distance between said two smooth annular surfaces.

52. The apparatus of claims 49 or 50, wherein:

said inner and outer smooth annular surfaces comprise inner and outer smooth cylindrical surfaces, the coils of said coiled spring means having an outer diameter greater than the distance between said inner and outer smooth cylindrical surfaces prior to location of said coiled spring means in said annular space.

53. A vibration resistant anti-counter rotational apparatus comprising:

first structural means;

second structural means having a portion located around a portion of said first structural means, said second structural means and said first structural means comprising wall structure defining an annular space between said first and second structural means, one of said structural means being rotatable relative to said other structural means, coiled spring means located in said annular space, said coiled spring means being characterized such that adjacent coils of said coiled spring means are in close proximity to each other, said wall structure of said second structural means and said first structural means engaging said coils of said spring means and canting said coils of said spring means in said first direction upon rotation of said one structural means in said first direction, relative to said other structural means, whereby increased resistance is provided to rotation of said one structural means, relative to said other structural means, in a direction opposite said first direction, said wall structure of said second structural means and said first structural means which engage said coils of said coiled spring means comprising smooth annular surfaces.

54. The apparatus of claim 53, wherein:

said wall structure of said second structural means and said first structural means which engage said coils of said coiled spring means comprise inner and outer smooth annular surfaces spaced radially from each other and formed on said second structural means and on said first structural means respectively.

55. The apparatus of claim 54, wherein:

said inner and outer smooth annular surfaces comprise inner and outer cylindrical surfaces, the coils of said coiled spring means having an outer diameter greater than the distance between said inner and outer smooth cylindrical surfaces prior to location of said coiled spring means in said annular space.

* * * * *